US005211492A

United States Patent [19]

Hirano

[11] Patent Number: 5,211,492

[45] Date of Patent: May 18, 1993

[54] SERIAL IMPACT PRINTER

[75] Inventor: Seiichi Hirano, Nagano, Japan

[73] Assignee: Seiko Epson Corporation, Tokyo, Japan

[21] Appl. No.: 883,598

[22] Filed: May 14, 1992

[30] Foreign Application Priority Data

May 15, 1991 [JP] Japan ..... 3-110220

[51] Int. Cl.[5] ..... B41J 13/10

[52] U.S. Cl. ..... 400/645; 400/639; 400/248

[58] Field of Search ..... 400/636, 247, 248, 642, 400/643, 645, 644, 645.1, 645.2, 645.3, 645.4, 645.5, 646, 647.1, 639, 640

[56] References Cited

U.S. PATENT DOCUMENTS

| | | | |
|---|---|---|---|
| 4,341,480 | 7/1982 | Mailer | 400/645 |
| 4,491,854 | 1/1985 | Habelt et al. . | |
| 4,712,935 | 12/1987 | LaDue et al. | 400/247 |
| 4,767,114 | 8/1988 | Nishimoto . | |
| 4,787,764 | 11/1988 | Ikeda et al. | 400/639 |
| 4,883,375 | 11/1989 | Karube et al. | 400/639 |

FOREIGN PATENT DOCUMENTS

| | | | |
|---|---|---|---|
| 3228620 | 2/1984 | Fed. Rep. of Germany | 400/639 |
| 3421936 | 12/1984 | Fed. Rep. of Germany . | |
| 0188470 | 10/1984 | Japan | 400/645.1 |
| 0056579 | 4/1985 | Japan | 400/642 |
| 0114869 | 6/1986 | Japan | 400/642 |
| 62-257871 | 11/1987 | Japan . | |
| 0031666 | 2/1989 | Japan | 400/642 |
| 2203700 | 10/1988 | United Kingdom | 400/642 |

*Primary Examiner*—Eugene H. Eickholt
*Attorney, Agent, or Firm*—Blum Kaplan

[57] ABSTRACT

A serial impact printer is provided for printing on a printing medium. The serial impact printer is provided with a carriage, a printing head supported on the carriage and a platen having an outer surface adjacent the printing head to define a printing region therebetween. Tension rollers having outer surfaces positioned downstream of the platen for applying tension to the printing medium. The outer surface of the platen and the outer surfaces of the tension rollers define a plane tangent to the platen and the tension rollers. Supported on the carriage is a guide member having an end portion which protrudes through the plane towards the platen. The end portion of the guide member presses the printing medium out of the plane.

15 Claims, 4 Drawing Sheets

SERIAL IMPACT PRINTER

BACKGROUND OF THE INVENTION

This invention relates to a serial impact printer and, in particular, to a serial impact printer having a plurality of tension rollers which apply tension to a sheet of paper to be printed and a sheet guide which reduces the volume of noise produced by the printer.

A conventional serial impact printer 100 constructed in accordance with the prior art is shown in FIG. 1. Serial impact printer 100 is provided with a platen tension rollers 12 (only one shown), and sheet retaining rollers 13, 14 and 15. Platen 11 and tension rollers 12 are rotated in the directions of arrows A and B, respectively. The rotation of tension rollers 12 cause printing sheet P to travel in the direction of arrow C. A sheet retaining plate 16 is adapted to prevent a printing sheet P from being lifted away from platen 11 as it is conveyed through a printing region. The sheet is further guided past an impact dot head 20 and a carriage 21 on which head 20 is mounted. A sheet guide 17 and discharging sheet guides 18 and 19 are provided for guiding the front end portion of a printed sheet towards tension rollers 12. Carriage 21 is guided along guide shafts 22 and 23 to vertically move print head 20 across the printing sheet resting against platen 11.

Further, a guide member 24 is mounted on carriage 21. Guide member 14 is adapted to guide printing sheet P along the outer cylindrical wall of platen 11 at the printing region where platen 11 confronts print head 20. In order to guide sheet P along platen 11 towards tension rollers 12, guide member 24 is shaped with a small gap formed between the guide surface of the guide member 24 and the outer cylindrical wall of platen 11. In this manner, a tangent line extending from platen 11 to tension rollers 12 is formed representing the path of sheet P.

In serial impact printer 100, the peripheral speed of tension rollers 12 is rotated at a speed slightly greater than the peripheral speed of platen In this manner, the conveyance of sheet P by platen 11 is assisted by tension rollers 12. Further, a tension is applied to sheet P to prevent sheet P from being lifted from platen 11. The application of tension also reduces the volume of noise produced during printing. Although only one tension roller 12 is shown in FIG. 1, a plurality of tension rollers are arranged in the direction of the axis of platen 11. During the printing operation, guide member 24 is not in contact with sheet P as shown in FIG. 1.

The following problems are presented by the construction of the conventional serial impact printer described above. In a typical printing environment, sheets four to sixteen inches in length are used. As set forth above, a plurality of tension rollers 12 are arranged in the direction of the axis of platen 11. Hence, the tension is distributed in the width direction of sheet P. In this configuration, a suitable tension is applied to the section of the sheet confronting tension rollers 12. However, the tension applied to the section of the sheet not confronting tension rollers 12 is unsuitable. Therefore, this section of sheet P is lifted from platen 11 making it difficult to prevent the production of noises during the printing operation.

In order to uniformly distribute the tension over the sheet, a longer tension roller may be employed such that the roller is as long as platen 11. However, such a construction is also disadvantageous in that the longer components increase the manufacturing costs. Accordingly, it is difficult to reduce the manufacturing cost of the printer with a construction of this type. Since it is essential to polish the outer cylindrical wall of the tension roller, it is impossible to reduce the diameter of the tension roller and thereby miniaturize it, while maintaining a low manufacturing cost.

Alternatively, a sheet conveyance force of tension rollers 12 could be increased to maintain a suitable tension on the sheet of paper. However, since the peripheral speed of tension rollers 12 is greater than that of platen 11, sheet P slips on platen 11. Therefore, it is difficult to convey the sheet through the printer with high accuracy. When a continuous form sheet is used in conjunction with a push type tractor assembly, the printer is operated with sheet retaining rollers 13 and 14 r ®1 ®as ®d. Therefore, sheet P is more likely to slip on platen 11, and therefore may improperly travel over the tractor pins.

Accordingly, it is desired to provide a serial impact printer which can be manufactured at a relatively low cost which is miniaturized, and which conveys printing sheets with high printing accuracy while producing less noise.

SUMMARY OF THE INVENTION

Generally speaking, in accordance with the present invention a serial impact printer for printing on a printing medium is provided. The serial impact printer is provided with a carriage, a printing head supported on the carriage and a platen having an outer surface adjacent the printing head to define a print region therebetween. Tension rollers are provided and are positioned downstream of the platen for applying tension to the printing medium. Each tension roller also has an outer surface. The outer surface of the platen and the outer surface of the tension rollers define a plane tangent to the platen and the tension rollers. Also, supported on the carriage is a guide member having an end portion which protrudes through the plane towards the platen. The end portion of the guide member contacts the printing medium to press the printing medium out of the plane. In the preferred embodiment, the end portions range in length between about 1.0 mm and 2.5 mm. Further, the tension rollers are preferably separated approximately 50 mm from one another.

Accordingly, it is an object of the present invention to provide an improved serial impact printer.

A further object of the invention is to provide a serial impact printer which produces less noise during the printing operation.

Still a further object of the invention is to provide tension to the printing medium in an impact printer at a position near the platen.

Yet a further object of the invention is to provide a serial impact printer which prevents a printing medium from being lifted from the platen during the printing operation.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 2:
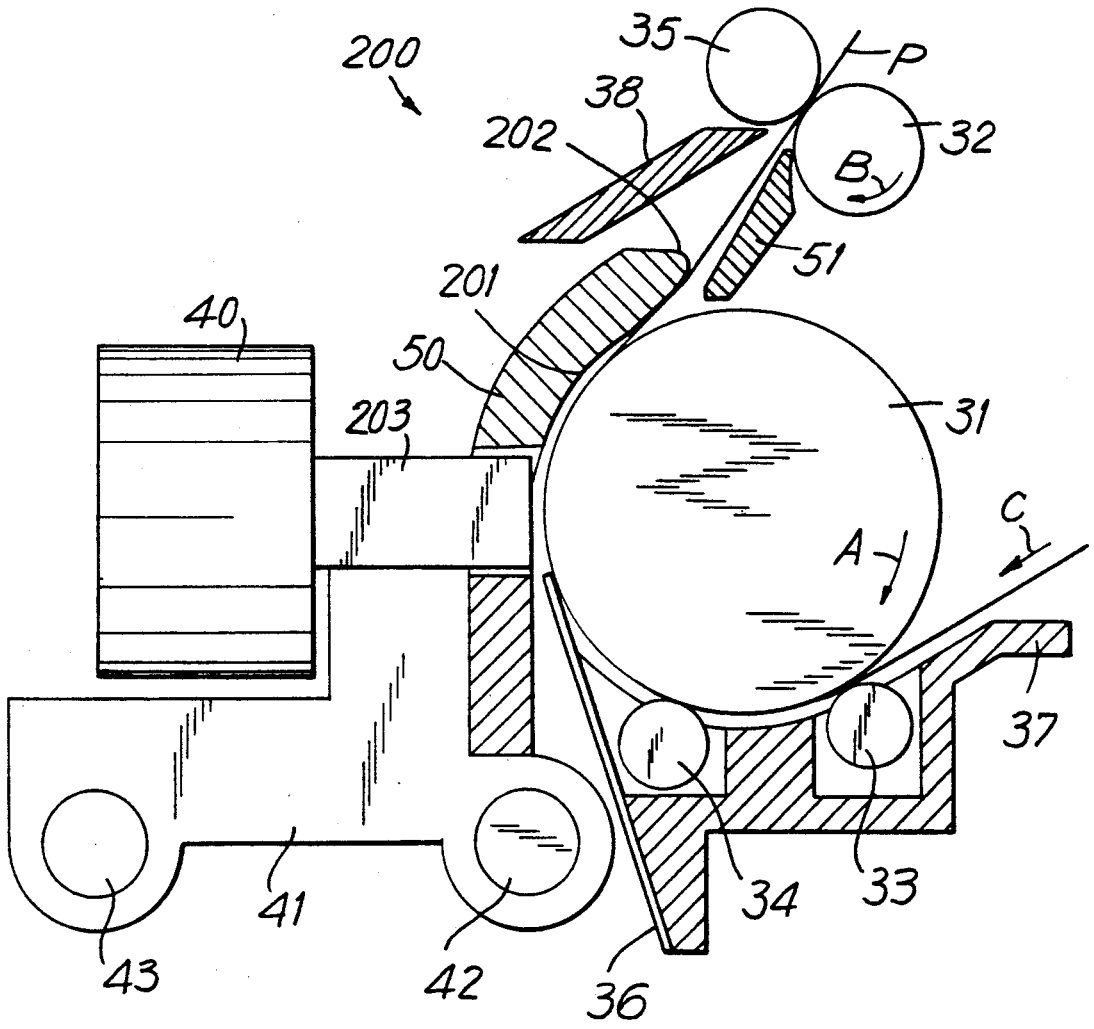
FIG. 2 is a side elevational sectional view of a serial impact printer constructed in accordance with the present invention.

Reference is first made to FIG. 2 which illustrates a serial impact printer, generally indicated at 200, and constructed in accordance with the present invention. Serial impact printer 200 is provided with a platen 31, tension rollers 32, and sheet retaining rollers 33, 34 and 35. Platen 31 and tension rollers 32 are rotated in the direction of arrows A and B, respectively, to convey a printing sheet P in the direction of arrow C. Tension rollers 32 are rotated at a peripheral speed slightly greater than the speed of platen 31.

Further, tension rollers 32 are arranged in the direction of the axis of platen 31 so that they are parallel with platen 31. A sheet retaining plate 36 is provided and adapted to prevent a printing sheet P from being lifted from platen 31 as it is conveyed to a printing region. A sheet guide 37 and discharging sheet guides 38 and 51 are provided for guiding the front end portion of a printed sheet to tension rollers 32 after the printed sheet has passed the printing region. Impact dot head 40 is provided and mounted on a carriage 41. Carriage 41 is moved along guide shafts 42 and 43.

Serial impact printer 200 is further provided with a guide member 50 mounted on carriage 41. Guide member 50 is adapted to guide printing sheet P along the outer cylindrical wall of platen 31. Sheet P is guided so that it is received in the printing region where platen 31 confronts impact dot head 20. Guide member 50 is formed with a guide surface 201 which is curved along the cylindrical surface of platen 31, so that it mirrors the shape of platen 31. In this manner, guide surface 201 is shaped to guide the front end portion of sheet P along platen 31 towards tension rollers 32.

Figure 1:
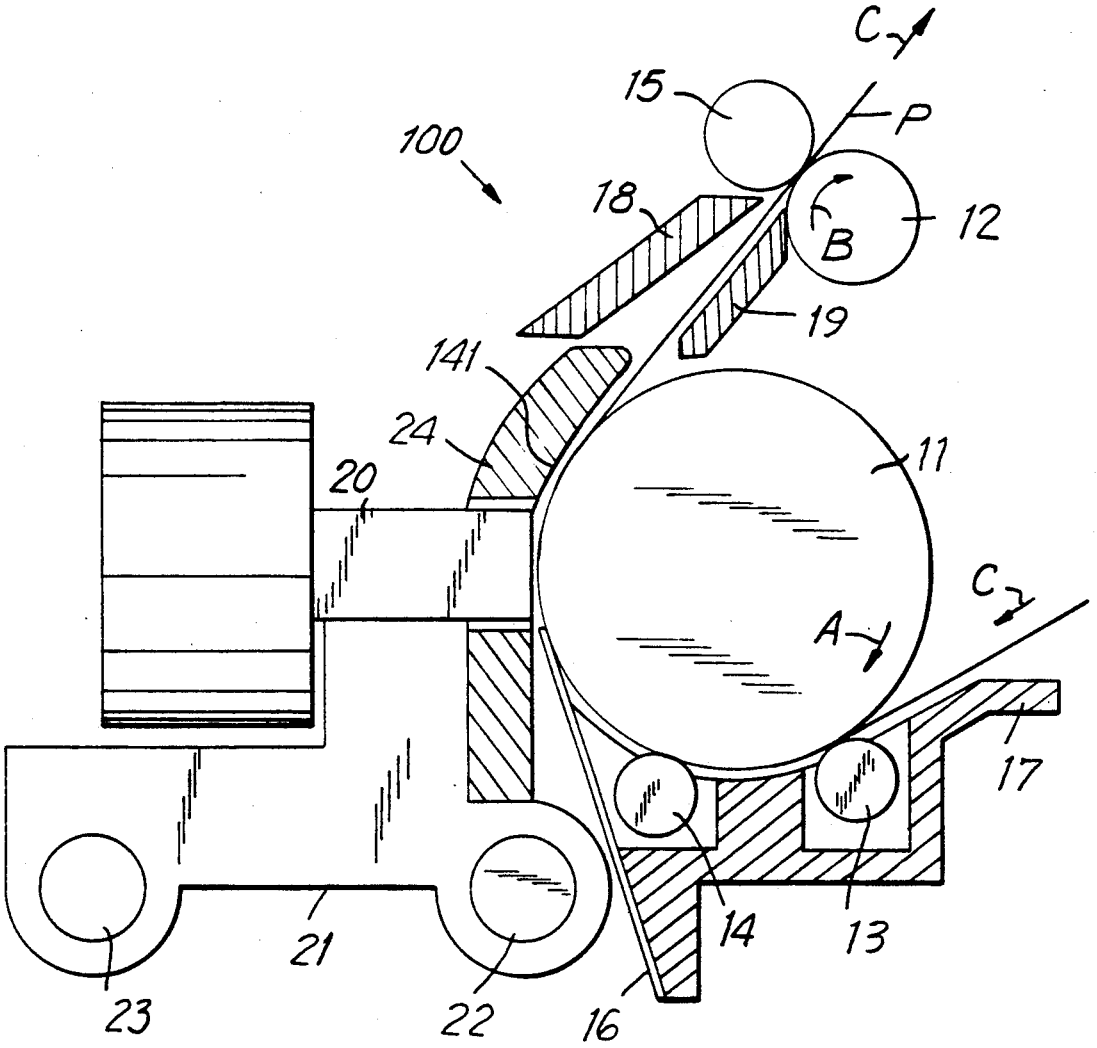
FIG. 1 PRIOR ART
FIG. 1 is a side elevational sectional view of a serial impact printer constructed in accordance with the prior art.
Figure 3:
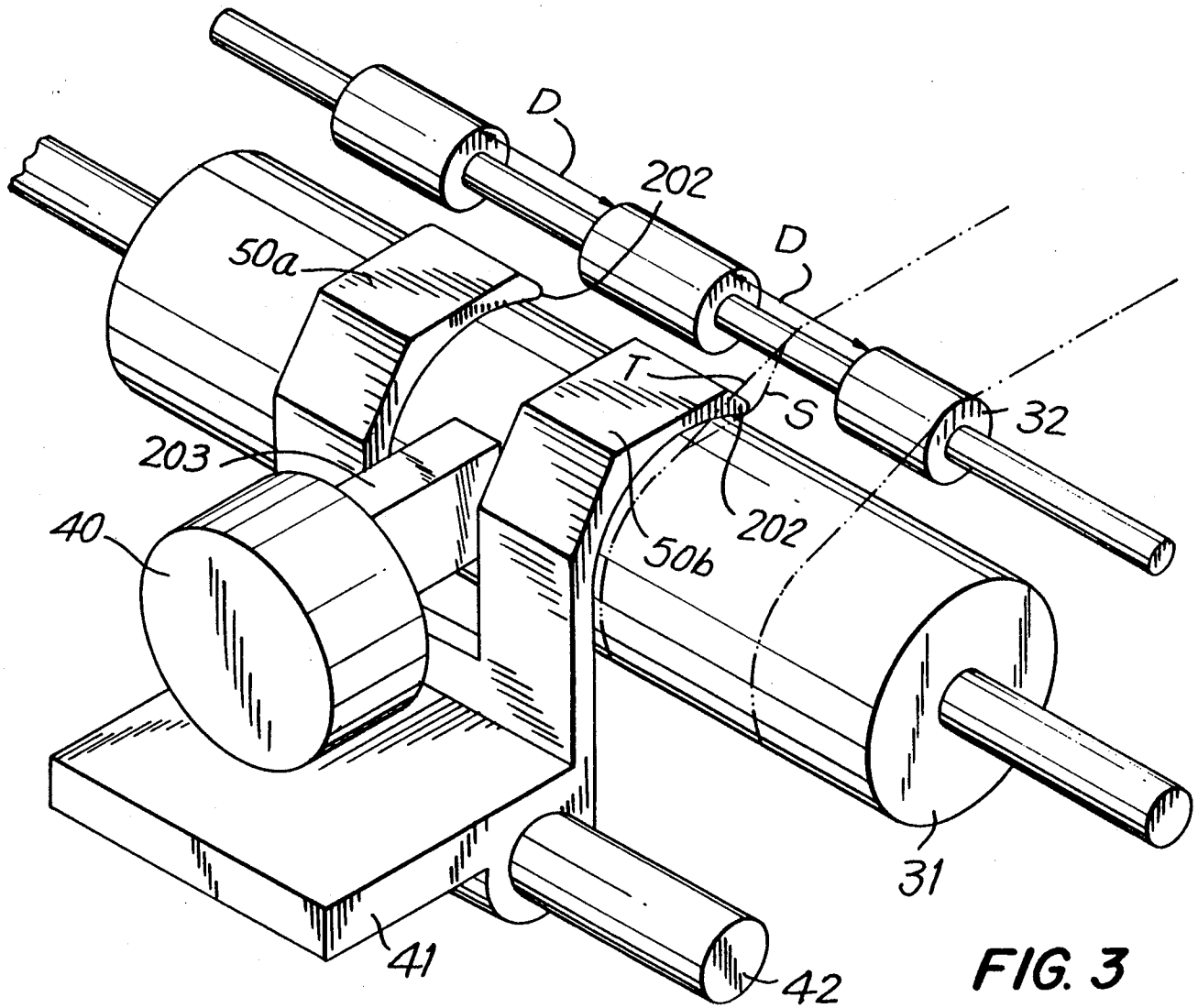
FIG. 3 is a perspective view of the serial impact printer of FIG. 2.
Figure 4:
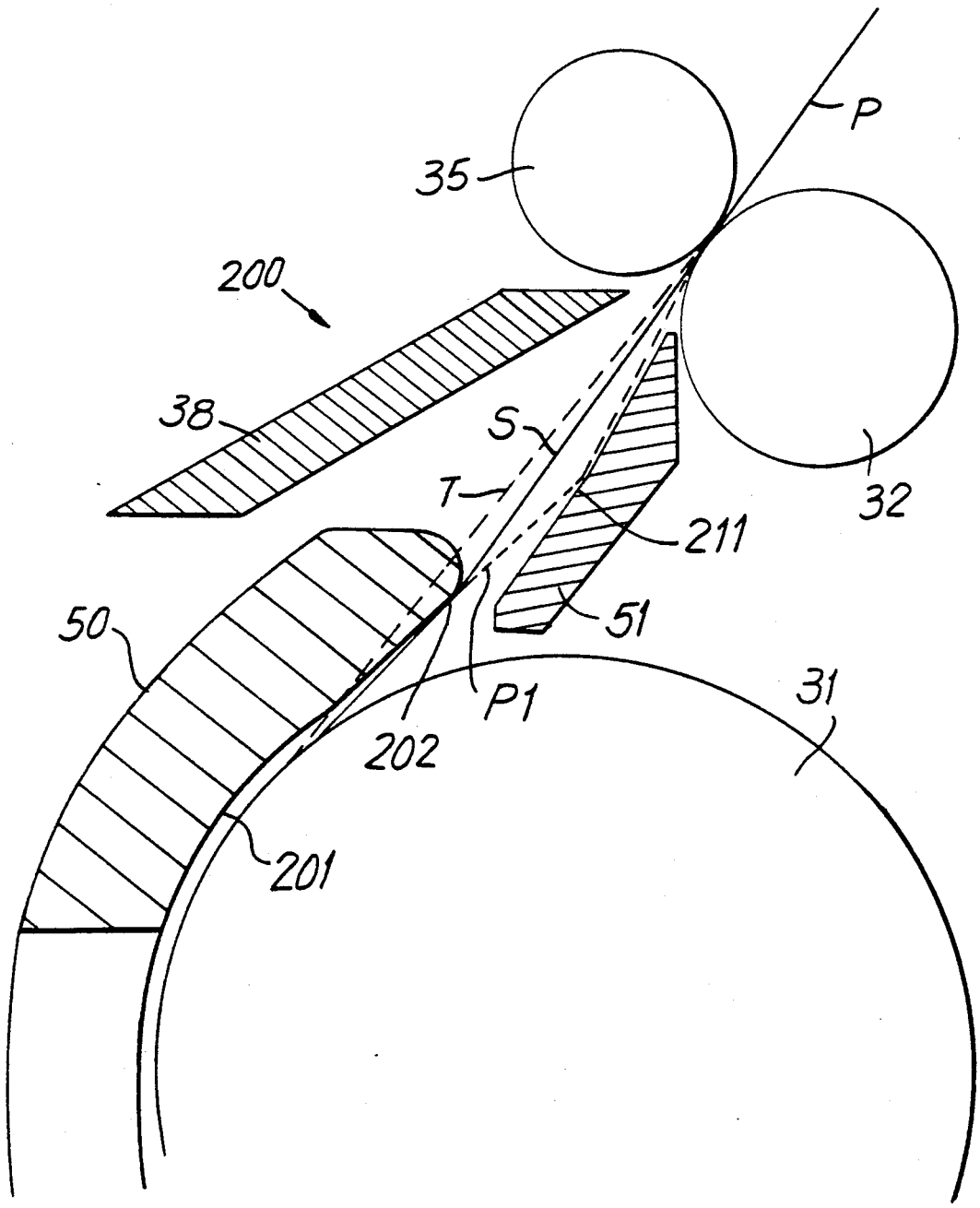
FIG. 4 is an enlarged sectional view of the printing sheet path of the serial impact head printer of FIG. 2.

Guide member 50 has an end portion 202 provided on the portion nearest tension rollers 32. End portion 202, as best shown in FIGS. 2 and 4, slightly protrudes towards platen 31 beyond the sheet path between platen 31 and tension rollers 32. In this manner, a tangent line T and the plane defined by the outer surfaces of the platen and the tension rollers, as shown in FIGS. 3 and 4, are crossed by end portion 202. In the prior art of FIG. 1, sheet P travels in the defined plane along the tangent line. In the present invention, the sheet is pressed out of the plane and directed in a direction as shown by path S in FIG. 3 from platen 31 towards tension rollers 32.

Referring specifically to FIG. 3, it is noted that guide member 50 includes two arms 50*a* and 50*b* which are similarly formed and which extend on opposite sides of print head 40. End portions 202 protrude towards platen 31 beyond the defined plane. As shown in FIG. 4, discharging sheet guide 51 has a guide surface 211 which is shaped to guide the front end portion of the sheet P towards tension rollers 32. Sheet P is further guided towards platen 31 by guide surface 201 of guide member 50. Therefore, the front end portion of the sheet P is guided as indicated by the broken line Pl in FIG. 4. In FIG. 4, line T is the aforementioned tangent line, paper path, to platen 31 and tension rollers 32 of the prior art.

In accordance with serial impact printer 200, printing sheet P travels in a manner as described below. Prior to reaching end portion 202 of the guide member 50, sheet P travels in a similar path as the prior art impact dot printer as represented by tangent line T shown in FIG. 4. However, when sheet P confronts end portion 202 of guide member 50, sheet P begins to curve and curl clockwise, since sheet P contacts end portion 202 as indicated by the solid line S in FIG. 4. Further, even in this configuration, a portion of sheet P does not confront tension rollers 32 as the sheet path is curled clockwise and brought into contact with guide member 50 when printing head 31 moves across sheet P. However, the sheet path is slightly increased in length, while the tension of sheet P is increased. Accordingly, a suitable tension is applied to sheet P, thus preventing the sheet from being lifted from platen 31. During operation, the peripheral speed of tension rollers 32 is greater than the peripheral speed of rotation of platen 31.

As can be readily appreciated from the above description, a greater area of sheet P is brought into contact with platen 31. Therefore, when sheet P is struck by printing wires 203 of impact dot head 40, the fluttering of sheet P is decreased. Accordingly, the volume of noise produced is also decreased.

Table 1, set forth below, outlines the results of noise measurements (in decibals) produced when the printer operates in a letter quality environment. The characters were printed at a rate of about ninety characters per second. More specifically, the test parameters were as follows: tension rollers 32 were spaced about 50 mm from one another (distance D shown in FIG. 3), the tension was about 20 g per 50 mm, the amount of protrusion of guide member end portion 202 beyond the tangent line and defined plane was varied between 0.0 to 3.0 mm, and the width of guide member end portion 202 was varied between 10 mm, 25 mm, and 50 mm.

TABLE 1

| | End Width | | |
|---|---|---|---|
| Protrusion | 10 mm | 25 mm | 50 mm |
| 0 mm | 57.2db(A) | 57.2db(A) | 57.0db(A) |
| 0.5 mm | 57.0 | 56.6 | 56.3 |
| 1.0 mm | 56.5 | 53.4 | 53.3 |
| 1.5 mm | 56.2 | 53.2 | 53.1 |
| 2.0 mm | 56.0 | 53.2 | 53.0 |
| 2.5 mm | 55.4 | 53.0 | 53.0 |
| 3.0 mm | 55.1 | 53.0 | 52.9 |

As set forth above in Table 1, in order to decrease the volume of noise, it is preferable that the width of guide member end portion 202 be at least half (½) of the space between tension rollers 32, while the amount of the protrusion of guide member end portion 202 beyond the plane is greater than 1.0 mm. However, when the amount of the protrusion of guide member end portion 202 is greater than 3.0 mm, guide member end portion 202 rubs strongly against the surface of sheet P which has just been printed. Therefore, the resulting printed sheet is smudged or dirtied. Accordingly, in the preferred embodiment, the amount of the protrusion of guide member end portion 202 beyond the plane should fall in the range of 1.0 mm to 2.5 mm.

Thus, serial impact printer 200 is constructed with following merits or effects. In the construction of the instant invention, guide member end portion 202 of guide member 50 protrudes towards platen 31 to contact sheet P. In this manner, at the contacting point, the sheet path is bent outwardly towards platen 31 to increase the tension applied to sheet P. Thus, a portion of sheet P is prevented from being lifted from platen 31. Further, although a plurality of tensions rollers 32 are arranged in the direction of axis of platen 31 and in parallel with the latter, tension is suitably applied to the portion of sheet P in the printing region. Therefore, even though tension rollers 32 are manufactured at a low cost and are small in diameter, the volume of noise can still be decreased.

Thus, serial impact printer 200 is low in manufacturing cost, small in size, and low in the volume of noise produced during printing. Furthermore, sheet P is prevented from being lifted from platen even when a low sheet conveying force is provided by the tension rollers. Hence, the printer is constructed so that the difficulties associated a sheet travelling over the pins with a push type tractor can be reduced even though the sheet conveying accuracy is lowered. Thus, the serial impact printer of the invention is excellent in the conveyance of a printing sheet, while reducing the volume of noise.

Accordingly, an impact serial printer is provided with tension rollers positioned downstream of a region with respect to the direction of conveyance of a printing sheet. More specifically, the tension rollers are positioned downstream from where a platen and an impact dot head confront with each other and a guide member which is moved towards the head. The guide member is provided to guide the sheet along the platen near the region where the platen and the head confront one another. Therefore, the guide member has an end portion which protrudes towards the platen through the plane defined by the portions of the tension rollers and the platen which are brought into contact with the printing sheet.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A serial impact printer for printing on a printing medium comprising a carriage, a printing head supported on the carriage, a platen having an outer surface adjacent said printing head defining a printing region therebetween, tension roller means having an outer surface positioned downstream of said platen for applying tension to the printing medium, the outer surface of said platen and the outer surface of said tension roller means defining a plane tangent to said platen and said tension roller means, a guide member supported on said carriage having an end portion which protrudes through said plane towards said platen, said end portion contacting said printing medium to press said printing medium out of said plane.

2. The serial impact printer of claim 1, wherein the tension roller means rotates at a peripheral speed greater than the peripheral speed of the platen.

3. The serial impact printer of claim 1, wherein the tension roller means include a plurality of tension rollers.

4. The serial impact printer of claim 3, wherein the plurality of tension rollers are separated approximately 50 mm from one another.

5. The serial impact printer of claim 1, wherein the amount of protrusion of the end portion of said guide member beyond said plane ranges between about 1.0 mm and 2.5 mm.

6. The serial impact printer of claim 1, wherein said guide member includes two spaced guide member arms having an end portion which protrudes through said plane.

7. The serial impact printer of claim 6, wherein each said guide member arm end portions extend over said platen.

8. The serial impact printer of claim 6, wherein said guide member arms are positioned on opposite sides of said print head.

9. The serial impact printer of claim 6, wherein each said guide member includes an inner surface forming said platen have a curved shape corresponding to the curve of said platen.

10. The serial impact printer of claim 1, further including sheet retaining roller means for guiding said printing medium through said printing region.

11. The serial impact printer of claim 1, further including discharging sheet guide means for guiding said printing medium from said printing region to said tension roller means.

12. The serial impact printer of claim 1, further including sheet retaining means for preventing said printing medium from being lifted from said platen as said printing medium is conveyed to said printing region.

13. The serial impact printer of claim 3, wherein said tension rollers are spaced from one another by a predetermined width, the wideth of said end portion of said guide member being at least one-half of said predetermined width.

14. The serial impact printer of claim 13, wherein the amount of protrusion of said end portion beyond said plane is greater than about 1 mm.

15. The serial impact printer of claim 14, wherein the amount of protrusion of said end portion beyond said plane is less than about 3 mm.

* * * * *